United States Patent [19]

Feuling

[11] Patent Number: 4,834,214

[45] Date of Patent: May 30, 1989

[54] MUFFLER FOR AN INTERNAL COMBUSTION ENGINE

[76] Inventor: James J. Feuling, 4035 N. Ventura Ave., Ventura, Calif. 93001

[21] Appl. No.: 59,511

[22] Filed: Jun. 8, 1987

[51] Int. Cl.[4] ..... F01N 1/10

[52] U.S. Cl. ..... 181/249; 181/252; 181/255; 181/282

[58] Field of Search ..... 181/247–252, 181/255, 256, 282, 264

[56] References Cited

U.S. PATENT DOCUMENTS

| | | | |
|---|---|---|---|
| 1,922,848 | 8/1933 | Harley | 181/264 |
| 1,934,462 | 11/1933 | Hartsock | 181/248 |
| 2,046,193 | 6/1936 | Spicer | 181/252 |
| 2,826,261 | 3/1958 | Eckel | 181/252 |
| 4,239,091 | 12/1980 | Negrao | 181/252 X |
| 4,632,216 | 12/1986 | Wagner et al. | 181/255 |
| 4,671,381 | 6/1987 | Rascov | 181/255 |
| 4,674,594 | 6/1987 | Jensen | 181/247 X |
| 4,690,245 | 9/1987 | Gregorich et al. | 181/249 X |

*Primary Examiner*—B. R. Fuller

*Attorney, Agent, or Firm*—Frank D. Gilliam

[57] ABSTRACT

A muffler for use with an internal combustion engine or the like having improved attenuation capabilities together with lower back pressure. The muffler has an elongated outer casing and an inner casing, the tubular ends of which extend beyond the outer casing for inlet, and outlet conducts. The central portion of the inner casing forms a continuation between the ends and has a differently configured but substantially equal cross-sectional area as the ends. The outer casing forms a sealed relationship with the inner casing adjacent the ends thereof. The central body portion is configured to have a portion in contact with the outer casing and a portion spaced from the outer casing. The surface of the spaced portion is perforated and sound absorption material is positioned in the space between the inner and out casing.

20 Claims, 2 Drawing Sheets

MUFFLER FOR AN INTERNAL COMBUSTION ENGINE

BACKGROUND OF THE INVENTION

The invention relates in general to sound attenuation and, more specifically, to mufflers for use with internal combustion engines, the flow of a fluid medium within a confined space or the like.

In many devices such as internal combustion engines, turbine engines, compressed gas powered tools, air handling systems, etc., considerable noise energy in generated and travels with the fluid or gasses. Such noise is objectable and must be reduced prior to exit from a noisy device. A wide variety of mufflers and other noise reducing devices have been developed.

Some mufflers use a plurality of baffles to radically change the path of the exhaust gases over a short distance. While such mufflers may be effective in reducing noise levels, they create undesirably high back pressure on the engines, resulting in lower engine power and efficiency.

Other mufflers direct exhaust gas straight through a perforated tube having a uniform configuration from end to end with sound adsorbing material such as glass fibers between the tube and outer housing. These so-called "glass-pack" mufflers produce low back pressure, but are not effective in reducing noise levels.

Generally speaking prior art mufflers have flow through resistance, produce acoustic wave reflections and have loss of column inerta.

Attempts have been made to combine baffles and sound absorbing materials to improve muffler efficiency. For example, Cullum in U.S. Pat. No. 2,613,758 uses a combination of connective tubes with sound absorbing material between a perforated inner tube and an outer tube, a narrow taper ended perforated cylinder along the muffler center-line and a set of baffler near the muffler exhaust end. Sanders in U.S. Pat. No. 3,114,431 and Paulsen in U.S. Pat. No. 2958,788 also disclose mufflers having sound absorbing walls and a core of sound absorbing material within the muffler. While these designs somewhat combine the noise reduction characteristics of the baffle-type muffler and the low back pressure of the straight through type muffler, none provide an optimum combination of high engine efficiency through low back pressure maximum noise reduction.

Also, some of these prior art mufflers are complex and heavy and others have short useful lives due to corrosion or susceptibility to burn-out from the hot gasses passing through them.

Applicants prior U.S. Pat. No. 4,263,982 for a muffler for internal engine of the like provided an improvement over the prior mufflers.

There is, however, a continuing, need to improve the, sound attenuating capabilities of mufflers. The instant invention provides further improvement in ideal characteristics of mufflers by maintaining no-back pressure gas flow there through, elimination of acoustive wave reflections, maintain column inerta, capable of ease of manufacture and have increased sound absorption properties.

SUMMARY OF THE INVENTIONS

The above problems, and other, as well as maintaining little or no back pressure and improved sound attenuation capabilities are provided in accordance with this invention by a newly designed muffler having an elongated outer casing surrounding an inner casing the tubular ends of which extend beyond the outer casing and have a sealed relationship therewith. The inner casing has a central chamber which forms a continuation of the ends but has a different cross-sectional configuration than the ends. The ends are tubular for attachment to conventional tail pipe systems used in automobile sound attenuation systems. Although the central portion has a differently configured cross-section than the tubular ends its cross-sectional area is substantially equal to the cross-sectional area of the tubular ends. The feature eliminates back pressure build up within the central portion. The cross-sectional configuration if the central area is formed to provide increased fluid flow surface area over a tubular shape. The increased surface area provides an increased sound treatment surface area which results in increased noise attenuation or absorption with no appreciable acoustic wave reflection and with no loss of column inerta. The increased surface area is perforated and spaced from the outer casing inner wall. Sound attenuation material fills the void or space between the perforation and outer casing inner wall. The perforations can vary in diameter to cause attenuation of sounds of different frequencies. A range of diameters from 0.050 inches to 0.375 inches attenuate a large range of noise frequencies.

A plurality of differently dimensioned central body portions are shown that provide increased surface area for improved sound attenuations when used with selected perforation diameters.

An object of this invention is to provide an improved muffler for an internal combustion engine.

Another object of this invention is to provide an improved muffler for an internal combustion engine, air handling systems or the like which has little or no resistance to normal fluid flow and yet reduces engine or air handling system generated noises.

Still another object of this invention is to produce a more efficient muffler than is low in economic cost and has a long life.

Other advantages and features of the invention will be apparent from the following description of several embodiments thereof, shown in the attached drawings, in which:

DETAILED DESCRIPTION OF THE DRAWINGS

Figure 1:
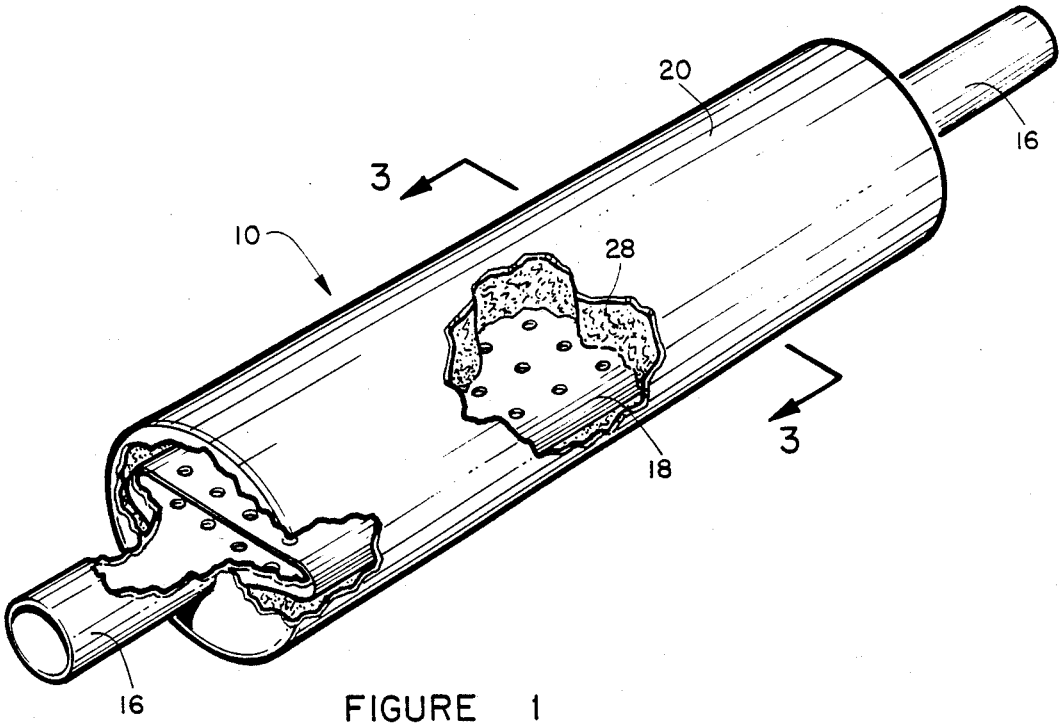
FIG. 1 is a perspective cut-away showing of a first embodiment of the invention.
Figure 2:
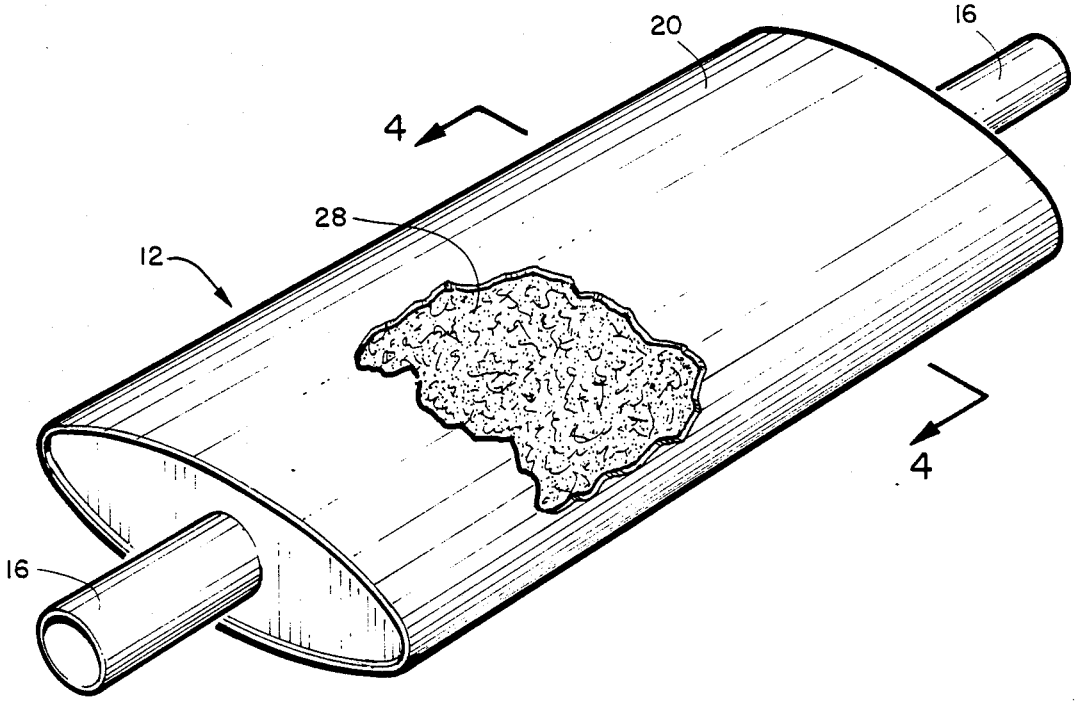
FIG. 2 is a perspective cut-away showing of a second embodiment of the invention.
Figure 3:
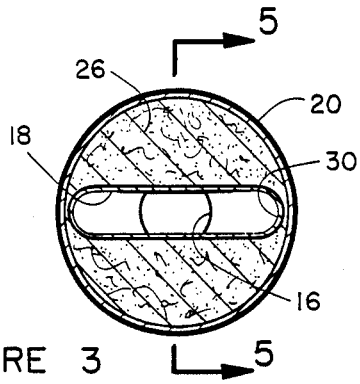
FIG. 3 is a showing of FIG. 1 taken along line 3—3.
Figure 4:
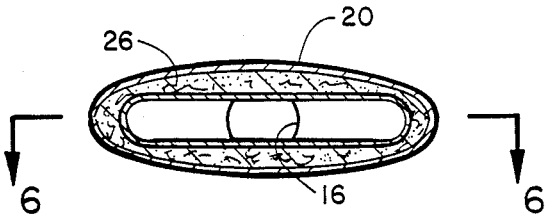
FIG. 4 is a showing of FIG. 2 taken along line 4—4.

Referring now to FIGS. 1 and 2 where an oval and a cylindrical muffler 10 and 12 are shown in partial cutaway to reveal the transistion connection 14 between each end tubular extension 16 and the central perforated chamber 18. As seen in other drawing Figures, hereinafter described, the cross-sectional configuration of the central perforated chamber 18 takes many different and unique shapes. The intent of the invention is to promote increased sound attenuation or absorption within the central perforated chamber 18 while maintaining minimal or no back pressure development between the inlet and outlet tubular extensions 16. This is accomplished by maintaining equal cross-sectional area in the fluid flow path, i.e. from the inlet through the perforated central portion and out the outlet.

Figure 6:
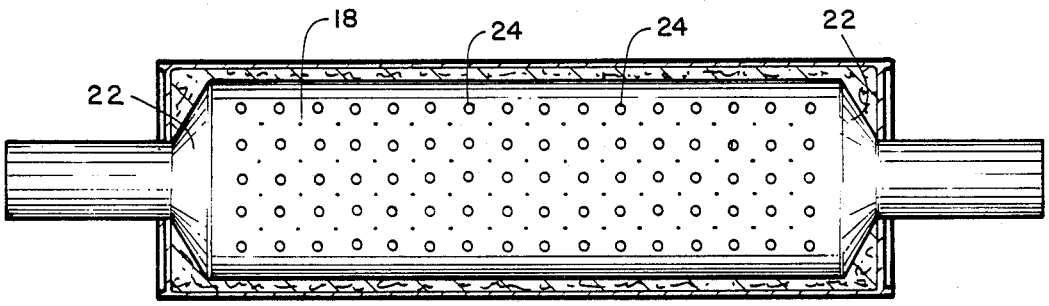
FIG. 6 is a showing of FIG. 4 taken along line 6—6.

As can be seen in FIG. 6, the outer casing 20 is typical or a standard conventional muffler. The outer casing is shown as either tubular or oblong by way of examples and not by way of limitations as various other outer casing shapes could be utilized to practice this invention. Positioned within the outer casing 20 is an inner casing 18.

Intercasing 18 transistions by a transition number 22 between the tubular shape of end extension 16 and the forward portion of the inner casing 18 to which the transition number 22 is attached. The inner casing surfaces which contact the outer casing are attached thereto by any convenient means suitable for the purpose intended. Welding, brazing, riveting are examples of means to connect the inner casing to the outer casing, however, the connection means is not limited thereto. The connecting means provides a fluid sealed relationship between the tubular ends, inner casing 18 and the outer casing 20, i.e. there is a sealed flow path between the inlet and outlet end extension 16.

Referring now to FIG. 6, in this Figure, the inner casing is shown. All of the surface area of the inner casing, except those areas which are fastened to the outer casing 20 have a plurality of perforation 24 therethrough. Positioned adjacent the perforated surfaces of the inner casing 20 in the void 26 between the inner casing and the outer casing is a quantity of absorbent material 28 packed therein. The packing material is generally a fibrous type material sufficiently packed to remain in position under normal expected use of the muffler yet loose enough to have air space between the fiber of construction. The packing material must also be selected to withstand the heat of the gasses flowing through the inner casing 20. It has been found that packing material made from Kevlar®, fiberglass, steel, wool or the like, for example, are suitable for this purpose.

The perforations 24 may be equally or randomly spaced and may be of more than one diameter to take advantage of the Helmholtz resistant cavity attenuation principles. The diameter range of the perforations may vary from 0.050 to 0.375 inches.

The diameter of the perforations and the amount of open space in the packing material is believed to be directly related to the amount and frequency of noise attenuation.

Figure 5:
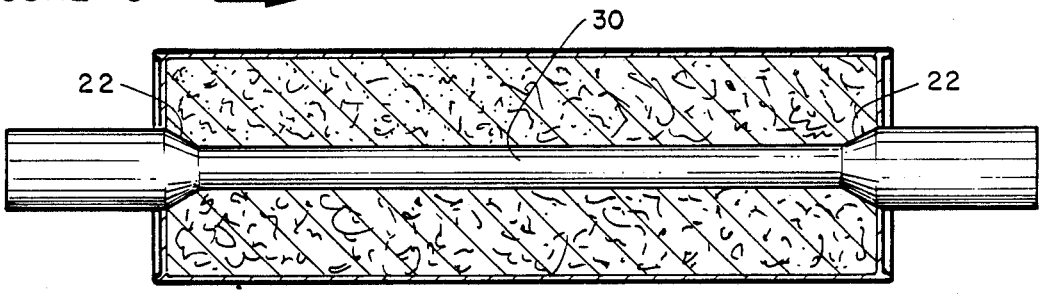
FIG. 5 is a showing of FIG. 3 taken along line 5—5.

FIG. 5 is a typical example of an inner casing to outer casing connecting non-perforated wall 30.

As forementioned, the cross-sectional configuration may take many different and noval shapes while maintaining a cross-sectional area substancially equal to the end cross section area of end extensions 16 which attach to a conventional engine header and tail pipe.

FIGS. 1–5 depict a rectangular configuration.

Figure 7:
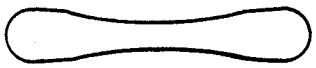
FIG. 7 is a cross-sectional showing of a second embodiment of the central casing.

FIG. 7 depicts a cross-sections having two side by side inter-connecting lobes.

Figure 8:
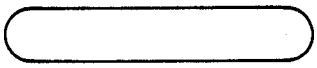
FIG. 8 is a cross-sectional showing of a third embodiment of the central casing.

FIG. 8 depicts an oblong curvilinear cross-section.

Figure 9:
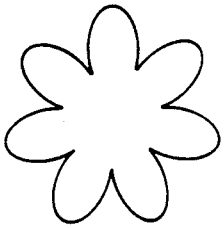
FIG. 9 is a cross-sectional showing of a fourth embodiment of the central casing.

FIG. 9 depicts a daisy pedal curvilinear cross-section.

Figure 10:
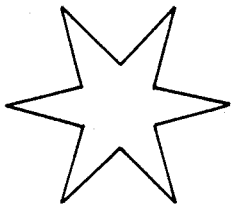
FIG. 10 is a cross-sectional showing of a fifth embodiment of the central casing.

FIG. 10 depicts a rectilinear six pointed star configuration. It should be obvious that stars having less than or more than six points could be utilized to practice the invention.

Figure 11:
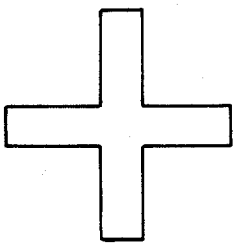
FIG. 11 is a cross-sectional showing of a sixth embodiment of the central casing.

FIG. 11 depicts a cross-section of the inner casing or configuration.

Figure 12:
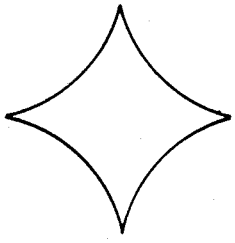
FIG. 12 is a cross-sectional showing of a seventh embodiment of the central casing.

FIG. 12 is directed to a cross-section of the inner casing in the form of a four sided rectilinear/curvilinear configuration.

Figure 13:
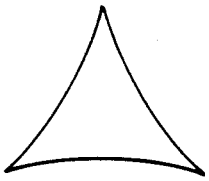
FIG. 13 is a cross-sectional showing of a eighth embodiment of the central casing.

FIG. 13 depicts an inner casing cross-section triangular shaped.

While certain specific proportions, materials and arrangements have been detailed in the above description of the preferred embodiments, these may be varied, where suitable, with similar results. For example, the muffler components may be formed from any suitable material, such as, for example and not by way of limitation, steel, aluminum, glass fiber reinforced plastic, etc.

Other variations, ramifications and applications of this invention will occur to those skilled in the art upon reading the present disclosure. These are rutted to be included within the scope of this invention or defined in the apended claims.

What is claimed is:

1. A muffler for use with an internal combustion engine comprising.

a first wall defining an elongated outer casing provided with first tubular ends:

an elongated inner casing having a central body portion with second tubular ends said central body portion being defined by a second wall the first tubular ends of said outer casing being attached to form a fluid tight seal with the inner casing adjacent to said second tubular ends, a cross section of said central body portion being substantially equal in cross-section to said second tubular ends but of a different cross-sectional configuration, said second wall of said central body portion being spaced from said first wall of said outer casing forming a space therebetween, the second wall of said central body portion between said second tubular ends being perforated therethrough with apertures having diameters within a range of 0.050 to 0.375 inches.

2. The invention is defined in claim 1 wherein said outer casing is curvilinear in cross-section.

3. The invention as defined in claim 1 wherein said outer casing is oblong in cross-section.

4. The invention as defined in claim 2 wherein said outer casing is oblong in cross-section.

5. The invention as defined in claim 1 wherein said central body portion is rectilinear in cross-section.

6. The invention as defined claim 1 wherein said central body portion is curvilinear in cross-section.

7. The invention as defined in claim 5 wherein said central body portion is a six pointed star in cross-section.

8. The invention as defined in claim 5 wherein said central body portion is curvilinear in cross-section.

9. The invention as defined in claim 5 wherein said central body portion is triangular in cross-section.

10. The invention as defined claim 6 wherein said central body portion is multi-lobed in cross-section.

11. The invention as defined in claim 1 wherein said perforations are substantially equal in cross-sectional area.

12. The invention as defined in claim 1 wherein said perforations have at least two different cross-sectional areas.

13. The invention as defined in claim 5 wherein said central body portion is oblong in cross-sectional area.

14. The invention as defined in claim 6 wherein said central body portion is oblong in cross-sectional area.

15. The invention as defined in claim 1 wherein said sound absorbing material comprises fibrous packing material.

16. The invention as defined in claim 14 wherein said fibrous packing material is fiberglass.

17. The invention as defined in claim 15 wherein said fibrous packing material is Kevlar®.

18. The invention as defined in claim 1 further comprising a portion of said second wall of said central body portion along a length thereof being in contact with the outer first wall of said outer casing and attached thereto.

19. The invention as defined in claim 1 wherein said apertures are substantially equally spaced apart.

20. The invention as defined in claim 1 wherein said apertures are randomly spaced apart.

* * * * *